US011350732B2

(12) United States Patent
Jimenez et al.

(10) Patent No.: US 11,350,732 B2
(45) Date of Patent: Jun. 7, 2022

(54) ORAL CARE IMPLEMENT

(71) Applicant: Colgate-Palmolive Company, New York, NY (US)

(72) Inventors: Eduardo Jimenez, Manalapan, NJ (US); Douglas Hohlbein, Hopewell, NJ (US)

(73) Assignee: Colgate-Palmolive Company, New York, NY (US)

( * ) Notice: Subject to any disclaimer, the term of this patent is extended or adjusted under 35 U.S.C. 154(b) by 301 days.

(21) Appl. No.: 16/354,261

(22) Filed: Mar. 15, 2019

(65) Prior Publication Data

US 2020/0288860 A1 Sep. 17, 2020

(51) Int. Cl.

| | |
|---|---|
| ***A46B 15/00*** | (2006.01) |
| ***A46B 5/02*** | (2006.01) |
| ***A46B 9/04*** | (2006.01) |

(52) U.S. Cl.

CPC ..... *A46B 15/0087* (2013.01); *A46B 5/023* (2013.01); *A46B 9/04* (2013.01); *A46B 15/0081* (2013.01); *A46B 2200/1066* (2013.01)

(58) Field of Classification Search

CPC ..... A46B 15/0087; A46B 5/023; A46B 9/04; A46B 15/0081; A46B 2200/1026; A61B 17/24; A47L 13/14

USPC .... 401/184; 15/188, 110, 167.1, 207.2, 107, 15/186, 187; 601/139; D4/104, 136

See application file for complete search history.

(56) References Cited

U.S. PATENT DOCUMENTS

| | | | | |
|---|---|---|---|---|
| 1,797,946 | A * | 3/1931 | Eichel | A46B 11/001 401/184 |
| 1,910,414 | A | 5/1933 | Varga | |
| 4,128,910 | A | 12/1978 | Nakata et al. | |
| 4,654,921 | A | 4/1987 | Dinner | |
| 5,065,470 | A | 11/1991 | Diamond | |

(Continued)

FOREIGN PATENT DOCUMENTS

| | | | |
|---|---|---|---|
| CN | 201831194 | U | 5/2011 |
| CN | 104970545 | A | 10/2015 |

(Continued)

OTHER PUBLICATIONS

International Search Report and the Written Opinion of the International Searching Authority issued in International Application PCT/US2020/022696 dated Jul. 27, 2020.

(Continued)

*Primary Examiner* — Katina N. Henson

(57) ABSTRACT

An oral care implement including a handle and a head. The oral care implement may be formed entirely out of a resilient or flexible material. The head may include a base structure and a monolithic cleaning unit. The monolithic cleaning unit may include a block portion extending from a front surface of the base structure and a plurality of protuberances extending from a distal end of the block portion. The block portion may have a greater height than the protuberances. The protuberances may include central protuberances that extend from a distal surface of the block portion and peripheral protuberances that surround the block portion and extend from the front surface of the base structure. The monolithic cleaning unit may include ribs extending between adjacently positioned protuberances. The oral care implement may be suitable for babies.

18 Claims, 13 Drawing Sheets

(56) References Cited

U.S. PATENT DOCUMENTS

| | | | | |
|---|---|---|---|---|
| 5,571,140 | A | 11/1996 | Gura-Emerling | |
| 5,711,759 | A * | 1/1998 | Smith | A61J 17/02 601/139 |
| 5,810,856 | A | 9/1998 | Tveras | |
| 7,226,555 | B2 | 6/2007 | Weihrauch | |
| D619,370 | S | 7/2010 | Tegeder et al. | |
| 8,206,201 | B2 * | 6/2012 | Fioratti | B24D 13/145 451/526 |
| D688,046 | S | 8/2013 | Aslett et al. | |
| 8,528,145 | B2 * | 9/2013 | Boyd | A46B 15/0055 15/111 |
| 9,011,032 | B2 | 4/2015 | Schlatter | |
| D745,283 | S | 12/2015 | Phillips et al. | |
| 9,210,995 | B2 | 12/2015 | Su et al. | |
| 10,016,053 | B2 | 7/2018 | Hohlbein | |
| 10,136,723 | B2 | 11/2018 | Moskovich | |
| 10,368,633 | B2 | 8/2019 | Jimenez et al. | |
| 2004/0068810 | A1 * | 4/2004 | Lee | A46B 7/08 15/22.1 |
| 2009/0249571 | A1 * | 10/2009 | Rohrig | A46B 5/02 15/167.2 |
| 2017/0367469 | A1 * | 12/2017 | Jimenez | A46B 9/025 |

FOREIGN PATENT DOCUMENTS

| | | |
|---|---|---|
| EP | 1299017 | 4/2003 |
| IT | UD20100093 | 11/2011 |

OTHER PUBLICATIONS

Live-Right, LLC., "Baby Banana Brush with Handle," Creative Child Magazine [online] http://www.creativechild.com/products/view/baby-banana-brush-with-handle, retrieved from internet Oct. 16, 2017.

* cited by examiner

ORAL CARE IMPLEMENT

BACKGROUND

The present invention relates to oral care systems, and particularly to an oral care implement suitable for use with babies. Oral care implements such as toothbrushes are susceptible to bacterial contamination resulting from normal use and handling. Bacterial accumulations may be especially prevalent on the head portion of the toothbrush, particularly within the tooth cleaning elements such as bristles and/or elastomeric cleaning elements. The bacteria can contribute to tooth decay and gum disease. Bacterial contamination of the toothbrush head which poses a general health risk is also a concern considering the head is placed in the oral cavity. Such contamination may be transferred from various hard surfaces on which the toothbrush might be placed or accidentally dropped. It is desirable therefore to minimize bacterial contamination from various environmental sources. It is further desirable to construct a toothbrush for use with babies (infants or toddlers) that is soft and pliable to prevent injury while also ensuring that no parts thereof, such as the bristles, can be detached which could pose a potential choking hazard.

BRIEF SUMMARY

The present invention is directed to an oral care implement including a handle and a head. The oral care implement may be formed entirely out of a resilient or flexible material. The head may include a base structure and a monolithic cleaning unit. The monolithic cleaning unit may include a block portion extending from a front surface of the base structure and a plurality of protuberances extending from a distal end of the block portion. The block portion may have a greater height than the protuberances. The protuberances may include central protuberances that extend from a distal surface of the block portion and peripheral protuberances that surround the block portion and extend from the front surface of the base structure. The monolithic cleaning unit may include ribs extending between adjacently positioned protuberances. The oral care implement may be suitable for babies.

In one aspect, the invention may be an oral care implement comprising: a handle; a head coupled to the handle, the head comprising a base structure and a monolithic cleaning unit, the monolithic cleaning unit comprising; a block portion extending from a front surface of the base structure to a distal surface, the block portion having a first height measured from the front surface of the base structure to the distal surface; and a plurality of protuberances extending from the distal surface of the block portion, at least one of the plurality of protuberances having a second height measured from the distal surface of the block portion to a distal end of the protuberance, the second height being equal to or less than the first height.

In another aspect, the invention may be an oral care implement comprising: a handle; a head coupled to the handle, the head comprising a base structure and a cleaning unit, the cleaning unit comprising; a block portion extending from a front surface of the base structure to a distal surface; and a plurality of protuberances extending from the distal surface of the block portion; and wherein the head, including the base structure and the cleaning unit, is a monolithic structure formed from a flexible material.

In yet another aspect, the invention may be an oral care implement comprising: a handle; a head having a longitudinal axis coupled to the handle, the head comprising a base structure and a monolithic cleaning unit, the monolithic cleaning unit comprising; a block portion extending from a front surface of the base structure to a distal surface; a plurality of central protuberances extending directly from the distal surface of the block portion; and a plurality of peripheral protuberances extending from the front surface of the base structure and surrounding the block portion, the plurality of peripheral protuberances comprising a first portion that extends radially from an outer surface of the block portion and a second portion that protrudes from the distal surface of the block portion.

In a further aspect, the invention may be an oral care implement comprising: a handle; a head coupled to the handle, the head comprising: a base structure; and a monolithic cleaning unit coupled to the base structure, the monolithic cleaning unit comprising; a plurality of protuberances, each of the protuberances having a first height measured from a front surface of the base structure to a distal end of the protuberance; and a plurality of ribs, each of the ribs having a second height measured from the front surface of the base structure to a distal end of the rib, the second height being less than the first height, and wherein each of the ribs extends between and is coupled to two of the protuberances.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
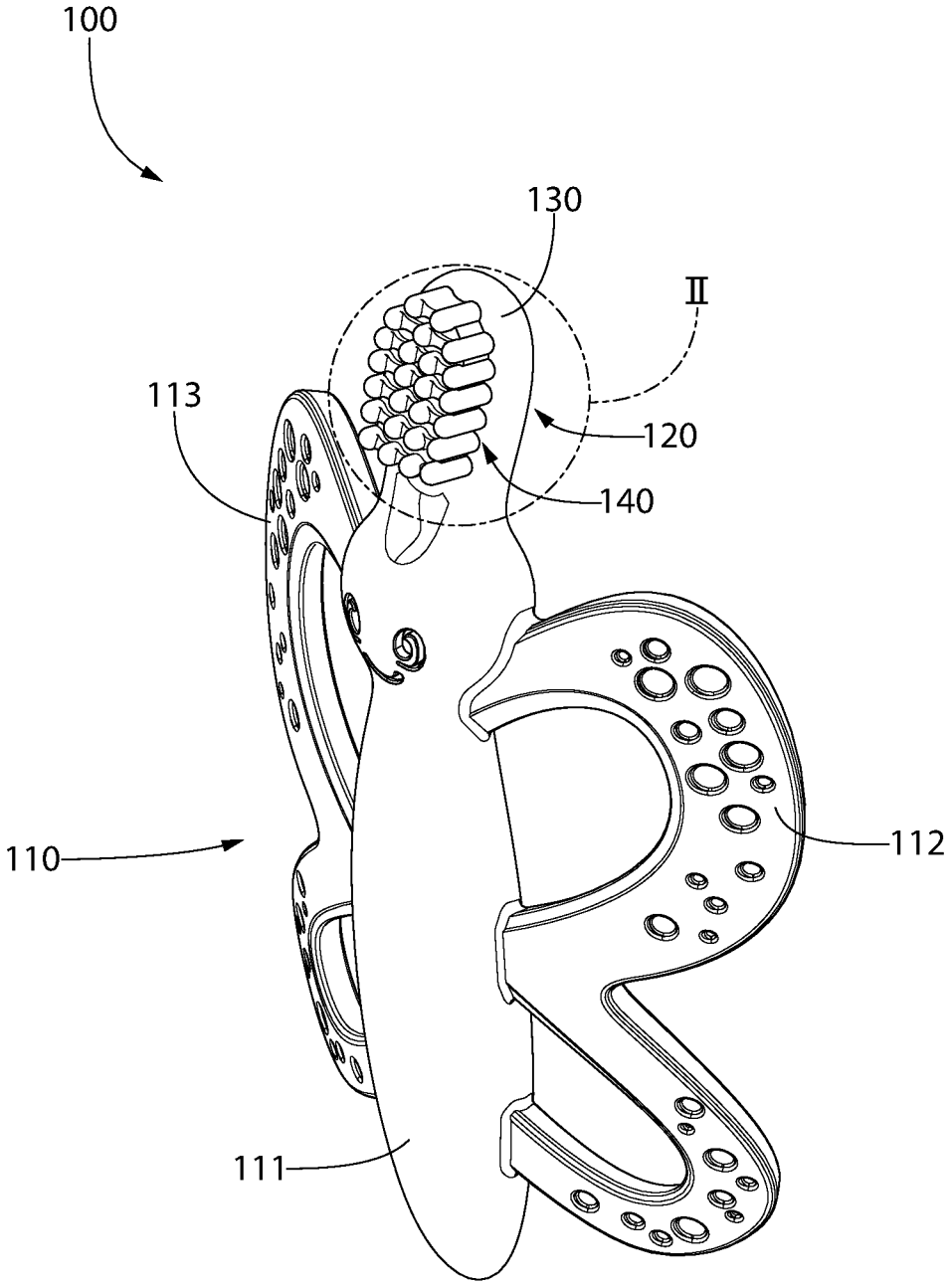
FIG. 1 is a front perspective view of an oral care implement in accordance with an embodiment of the present invention.
Figure 2:
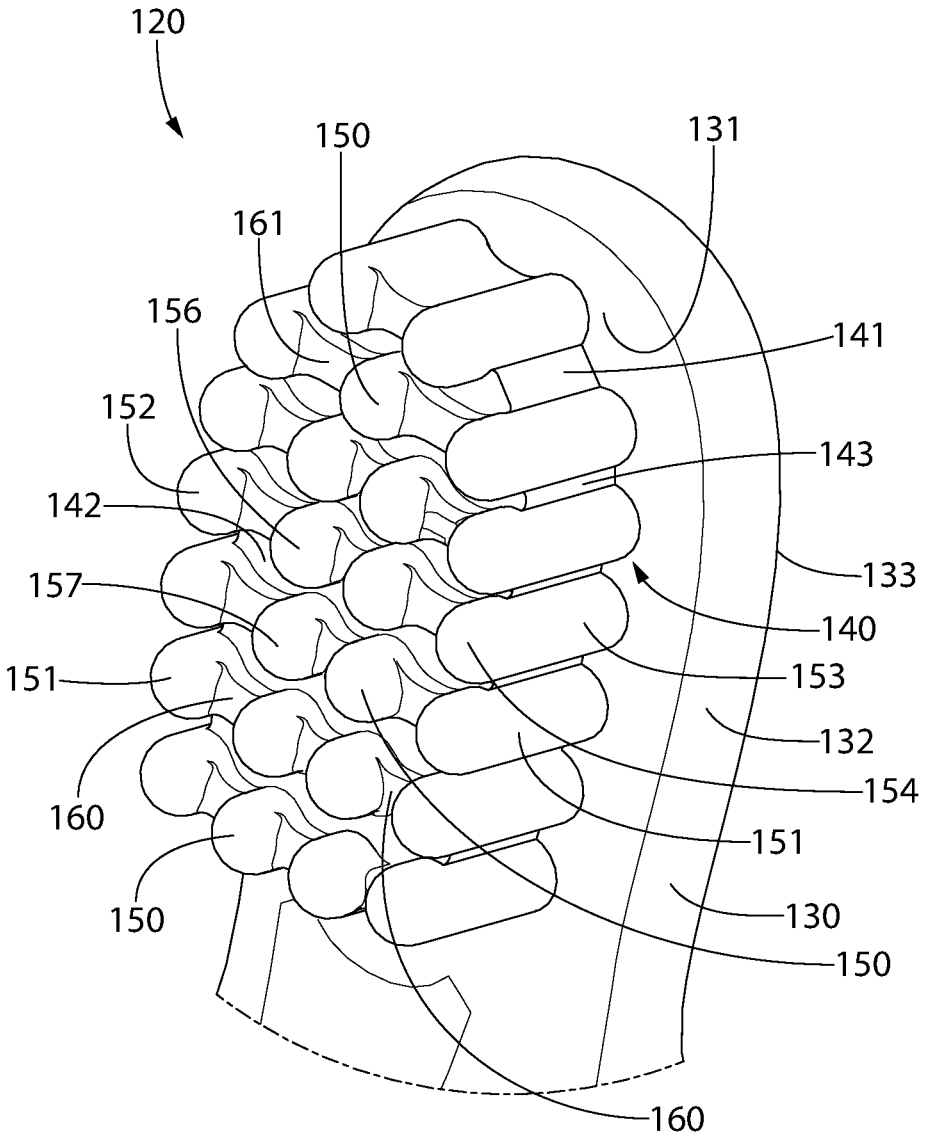
FIG. 2 is a close-up view of area II of FIG. 1 illustrating a head of the oral care implement.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, an oral care implement 100 is illustrated in accordance with an embodiment of the present invention. The oral care implement 100 generally comprises a handle 110 and a head 120 coupled to the handle 110. In the exemplified embodiment, the oral care implement 100 is, in its entirety including both the handle 110 and the head 120, formed out of a single material. Thus, the oral care implement 100 is a monolithic structure. In the exemplified embodiment, the oral care implement 100 is formed from an injection molding process, but it could be formed in other ways such as extrusion, 3D printing, or the like. In the exemplified embodiment, the oral care implement 100 is formed from a flexible or resilient material, such as an elastomeric material including without limitation thermoplastic elastomers such as food-grade silicone or other rubber-like materials. However, the invention should not be so limited in all embodiments and in other embodiments the handle 110 may be formed of a different material than portions of the head 120. Thus, for example, the handle 110 and a base structure of the head 120 could be formed of a rigid material (e.g., hard plastic) and a cleaning unit of the head 120 could be formed of one of the flexible materials noted above. In still other embodiments, the handle 110 could be formed of a rigid material (e.g., hard plastic) and the head 120 could be formed of a flexible material. However, in the exemplified embodiment the entire oral care implement 100 is a monolithic structure formed of a single elastomeric material.

In the exemplified embodiment, the handle 110 comprises an elongated gripping portion 111 and first and second appendages 112, 113 extending from opposing sides of the elongated gripping portion 111. The oral care implement 100, in the exemplified embodiment, is intended to have the appearance of a butterfly. Thus, the first and second appendages 112, 113 have the appearance of butterfly wings. The first and second appendages 112, 113 may help to support the oral care implement 100 on a horizontal surface without the head 120 contacting the horizontal surface to avoid contamination. Furthermore, the first and second appendages 112, 113 may ensure that a baby cannot insert too much of the oral care implement 100 into his/her mouth, thereby avoiding choking. Finally, the first and second appendages 112, 113 may enhance the ability of the oral care implement 100 to be gripped by an adult who is assisting a child in using the oral care implement 100 to clean oral surfaces and teeth. The first and second appendages 112, 113 can be bent relative to the elongated gripping portion 111 which can enable the handle 100 to be more easily gripped by an adult.

The head 120 comprises a base structure 130 and a monolithic cleaning unit 140. As noted above, in some embodiments the base structure 130 and the monolithic cleaning unit 140 are formed together as a monolithic structure. In other embodiments, the base structure 130 and the monolithic cleaning unit 140 may be separately formed and later coupled together. For example, the base structure 130 may be formed from a hard plastic and the monolithic cleaning unit 140 formed from a flexible or elastomeric material that is coupled to the base structure 130. However, in preferred embodiments the base structure 130 and the monolithic cleaning unit 140 are part of a monolithic, unitary, integral structure formed from a flexible or otherwise resilient material. In still other embodiments, the base structure 130 and the monolithic cleaning unit 140 may be formed separately, but both formed out of flexible or resilient materials such as a thermoplastic elastomer.

Referring to FIGS. 2-8, the head 120 of the oral care implement 100 will be described in greater detail. The base structure 130 comprises a front surface 131, a rear surface 132 opposite the front surface, and a side surface 133 extending between the front and rear surfaces 131, 132. In the exemplified embodiment, the rear surface 132 is smooth and has no features extending therefrom. However, in other embodiments the rear surface 132 could have protruding features, such as nubs or the like that are generally used for tongue and soft tissue cleaning.

In the exemplified embodiment, the monolithic cleaning unit 140 extends from the front surface 131 of the base structure 130. The monolithic cleaning unit 140 is generally comparable to the bristles or other cleaning elements used on a conventional oral care implement. Thus, conventional oral care implements use nylon or other material to form bristles that are clustered together into tufts that are attached to a base structure. Such conventional oral care implements may also include rubber elements known as lamella. However, in such conventional oral care implements the bristles may detach from the base structure during normal use and even more so if the head is used as a chew toy as may occur when the oral care implement is intended for use by a baby (infant or toddler). Bristles detaching from the base structure can be a choke hazard for a baby and are therefore undesirable.

Thus, many baby toothbrushes use only rubber features extending from a base structure as the "cleaning elements" or "bristles." However, when such rubber features are elongated in their extension from the base structure, they may still be detached from the base structure when extensively chewed by a baby or young child. The monolithic cleaning unit 140 described herein is intended to avoid any possibility of the baby or child detaching the "bristles" or "cleaning elements" from the remainder of the toothbrush.

In that regard, the monolithic cleaning unit 140 comprises a block portion 141 and a plurality of protuberances 150. The plurality of protuberances 150 form the "cleaning elements" of the oral care implement 100. Specifically, the plurality of protuberances 150 are the portion of the monolithic cleaning unit 140 that come into contact with a user's teeth (or gums, particularly for babies that likely do not yet have teeth) during use. Thus, the plurality of protuberances 150 are intended to resemble the cleaning elements or bristles on a more traditional toothbrush while removing any potential choke hazards. In this way, a child can get used to the concept of using a toothbrush without fear of choking on any of its components. Even if the oral care implement 100 is used as a baby chew toy, it is extremely unlikely that any part of the oral care implement will become detached and form a choke hazard.

In the exemplified embodiment, the monolithic cleaning unit 140 is a single, monolithic structure that includes the block portion 141 and the protuberances 150. The monolithic cleaning unit 140 may be formed from a resilient, flexible material such as a thermoplastic elastomer including without limitation food-grade silicone or the like.

The block portion 141 of the monolithic cleaning unit 140 extends from the front surface 131 of the base structure 130 to a distal surface 142. As seen in the cross-section views, the block portion 141 is a solid block of material that extends from the base structure 130. In this embodiment, the distal surface 142 of the block portion 141 is a planar surface. The distal surface 142 of the block portion 141 forms a platform that is elevated relative to the front surface 131 of the base structure 130. The block portion 141 also comprises an outer surface 143 that extends from the front surface 131 of the base structure 130 to the distal surface 142. The block portion 141 may take on any of a number of different shapes, including being square, rectangular, triangular, hexagonal, octagonal, circular, or arch-shaped (which is the shape of the block portion 141 of the monolithic cleaning unit 140 in the exemplified embodiment).

The plurality of protuberances 150 of the monolithic cleaning unit 140 extend or protrude from the distal surface 142 of the block portion 141 of the monolithic cleaning unit 140. In the exemplified embodiment, the monolithic cleaning unit 140 comprises twenty-five of the protuberances 150 including fourteen peripheral protuberances 151 and eleven central protuberances 156. Of course, the invention is not to be particularly limited by the number of protuberances 150 in all embodiments and this can be modified in many ways including adjusting the diameter of the protuberances 150, adjusting the spacing between the protuberances 150, and adjusting the surface area of the front surface 131 of the base structure 130 of the head 120. Each of the protuberances 150 comprises a maximum diameter D1 that is between 1 mm and 3 mm, more specifically between 1.5 mm and 2.5 mm, and still more specifically approximately 2 mm.

As mentioned above, the plurality of protuberances 150 comprises a plurality of peripheral protuberances 151 and a plurality of central protuberances 156. Each of the peripheral protuberances 151 extends directly from the front surface 131 of the base structure 130 to a distal end 152. However, the peripheral protuberances 151 are coupled to the outer surface 143 of the block portion 141 along a portion of their length. Thus, although the peripheral protuberances 151 extend directly from the front surface 131 of the base structure 130, each of the peripheral protuberances 151 also extends directly from the outer surface 143 of the block portion 141 in a direction away from a longitudinal axis A-A of the head 120.

The peripheral protuberances 151 are arranged in a circumferentially spaced apart manner about the outer surface 143 of the block portion 141 such that the peripheral protuberances 151 collectively surround the block portion 141. The peripheral protuberances 151 comprise a first portion 153 that extends radially from the outer surface 143 of the block portion 140 and a second portion 154 that extends upwardly from the distal surface 142 of the block portion 140. Thus, the peripheral protuberances 151 are positioned alongside of the outer surface 143 of the block portion 140 and are in fact coupled to the outer surface 143 of the block portion 140. Stated another way, the peripheral protuberances 151 are not spaced apart from the block portion 140 but the peripheral protuberances 151 are coupled to the outer surface 143 of the block portion 140 along the entire height of the block portion 141.

The peripheral protuberances 151 have a height measured from the front surface 131 of the base structure 130 to the distal ends 152 that is greater than a height of the block portion 141 measured from the front surface 131 of the base structure 130 to the distal surface 142 of the block portion 141. As a result, the second portion 154 (which is a distal portion) of the peripheral protuberances 151 protrude beyond the distal surface 142 of the block portion 141. This makes the second portion 154 of the peripheral protuberances 151 available to contact a user's gums and other oral surfaces when the head 120 is placed into the user's mouth. Furthermore, by maintaining the peripheral protuberances 151 in a coupled relationship with the block portion 141, it would be extremely difficult if not impossible for a baby or toddler to detach the peripheral protuberances 151 from the remainder of the oral care implement 100.

Figure 8:
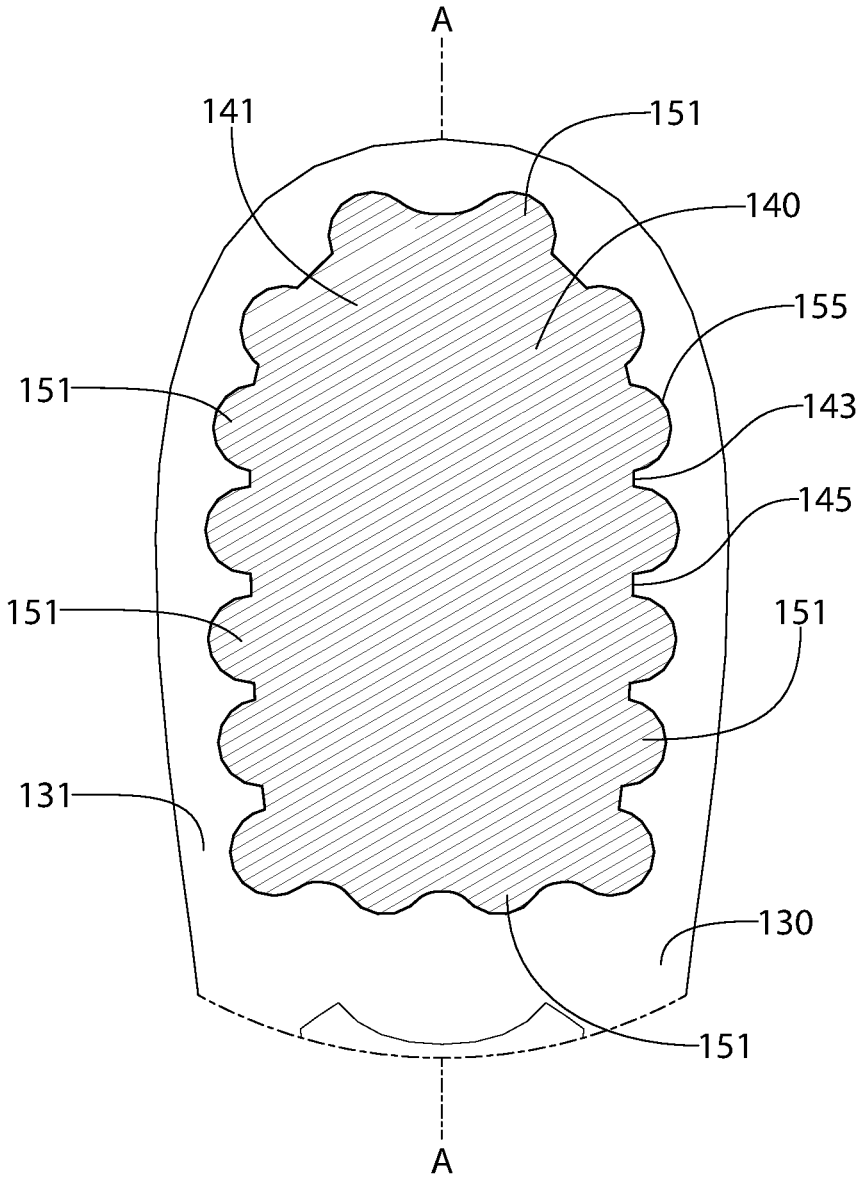
FIG. 8 is a cross-sectional view taken along line VIII-VIII of FIG. 4.

In the exemplified embodiment, the first portions 153 of the peripheral protuberances 151 are in the shape of a truncated cylinder that has been cut by a single plane oriented parallel to the cylinder's axis of symmetry. The second portions 153 of the peripheral protuberances 151 are cylindrical in shape, although the distal ends 152 may be rounded. The outer surface 143 of the block portion 141 and an outer surface 155 of the first portions 153 of the peripheral protuberances 151 collectively form an entirety of an outer surface 145 of the monolithic cleaning unit 140. As best seen in FIG. 8, the outer surface 145 of the monolithic cleaning unit 140 comprises a plurality of linear or arcuate segments formed by the block portion 141 and a plurality of dome-shaped segments formed by the peripheral protuberances 151, arranged in an alternating fashion.

The peripheral protuberances 151 also serve to hide most of the block portion 141 from view, which gives the monolithic cleaning unit 140 an appearance that more closely resembles the appearance of the cleaning elements or bristles of a traditional toothbrush. Specifically, although the peripheral protuberances 151 are spaced apart about the outer surface 143 of the block portion 141, the spacing is quite close together. As a result, the block portion 141 is very minimally visible if it is visible at all, particularly when viewed in side profile. Thus, in giving the oral care implement 100 a quick glance one would not even know that the monolithic cleaning unit 140 includes the block portion 141.

Each of the central protuberances 156 extends directly from the distal surface 142 of the block portion 141 of the monolithic cleaning unit 140 to a distal end 157. The central protuberances 156 have a cylindrical shape with a nub-like appearance having a rounded distal end 157. The central protuberances 156 are arranged in a spaced apart manner along the distal surface 142 of the block portion 141 of the monolithic cleaning unit 140. The peripheral protuberances 151 surround the central protuberances 156 and the peripheral protuberances 151 are spaced apart from the central protuberances 156.

The central protuberances 156 and the peripheral protuberances 151 extend to the same height above the front surface 131 of the base structure 130. Thus, the distal ends 152 of the peripheral protuberances 151 and the distal ends 157 of the central protuberances 156 form a flat trim profile such that the distal ends 152, 157 of the peripheral and central protuberances 151, 156 lie in a common plane. Of course, the peripheral and central protuberances 151, 156 could extend to different heights in other embodiments and thus the invention is not to be so limited in all embodiments. Furthermore, some of the peripheral protuberances 151 may be taller than others such that the peripheral protuberances 151 have varying heights and some of the central protuberances 156 may be taller than others such that the central protuberances 156 have varying heights.

The plurality of protuberances 150 are arranged in a plurality of columns and rows. Specifically, the plurality of protuberances 150 comprise a first column C1 of the peripheral protuberances 151 on a first side of the block portion 141, a second column C2 of the peripheral protuberances 151 on a second side of the block portion 141, a third column C3 of the central protuberances 156 adjacent to the first column C1 and the fourth column C4 of the central protuberances 156 adjacent to the second column C1, the third and fourth columns C3, C4 of the central protuberances 156 being between the first and second columns C1, C2 of the peripheral protuberances 151. The first column C1 is spaced a first distance from the third column C3, the second column C2 is spaced a second distance from the fourth column C4, and the third column C3 is spaced a third distance from the fourth column C4. In the exemplified embodiment, the first and second distances are the same and are greater than the third distance. The protuberances 150 are also arranged in seven rows in the exemplified embodiment, although fewer or greater than seven rows could be used in other embodiments depending on the surface area of the head 120 and the spacing between the protuberances 150.

As noted above, the plurality of peripheral protuberances 151 surround the block portion 141 of the monolithic cleaning unit 140 and the plurality of central protuberances 156. Furthermore, a peripheral portion 134 of the front surface 131 of the base structure 130 surrounds the block portion 141. The peripheral protuberances 151 extend from the front surface 131 of the base structure 130 along the peripheral portion 134 of the front surface 131 of the base structure 130.

The monolithic cleaning unit 140 also comprises a plurality or ribs 160 extending from the distal surface 142 of the block portion 141 in the spaces between the protuberances 150. The ribs 160 extend from the distal surface 142 of the block portion 141 to a distal end 161. Each of the ribs 160 extends or is elongated in a direction that is generally transverse to the longitudinal axis A-A. As noted above, the protuberances 150 are arranged in rows. The ribs 160 extend between protuberances 150 in the same row, but there are no ribs extending between protuberances 150 in different rows. Each of the ribs 160 extends between two of the protuberances 150 that are adjacent to one another in the same row and every protuberance is connected to at least one adjacent protuberance by one of the ribs 160. More specifically, in the exemplified embodiment each protuberance 150 is connected to at least one but no more than two of the other protuberances 150 by the ribs 160. Each of the ribs 160 extends between pairs of adjacent protuberances in a single row. By connecting the protuberances 150 to one another, the ribs 160 make the monolithic cleaning unit 140 more robust so that it is quite difficult for one of the protuberances 150 to become detached from the block portion 141. This can be an important feature in some embodiments because it eliminates a potential choking hazard that may exist if any of the protuberances 150 were to become detached from the block portion 141.

Figure 3:
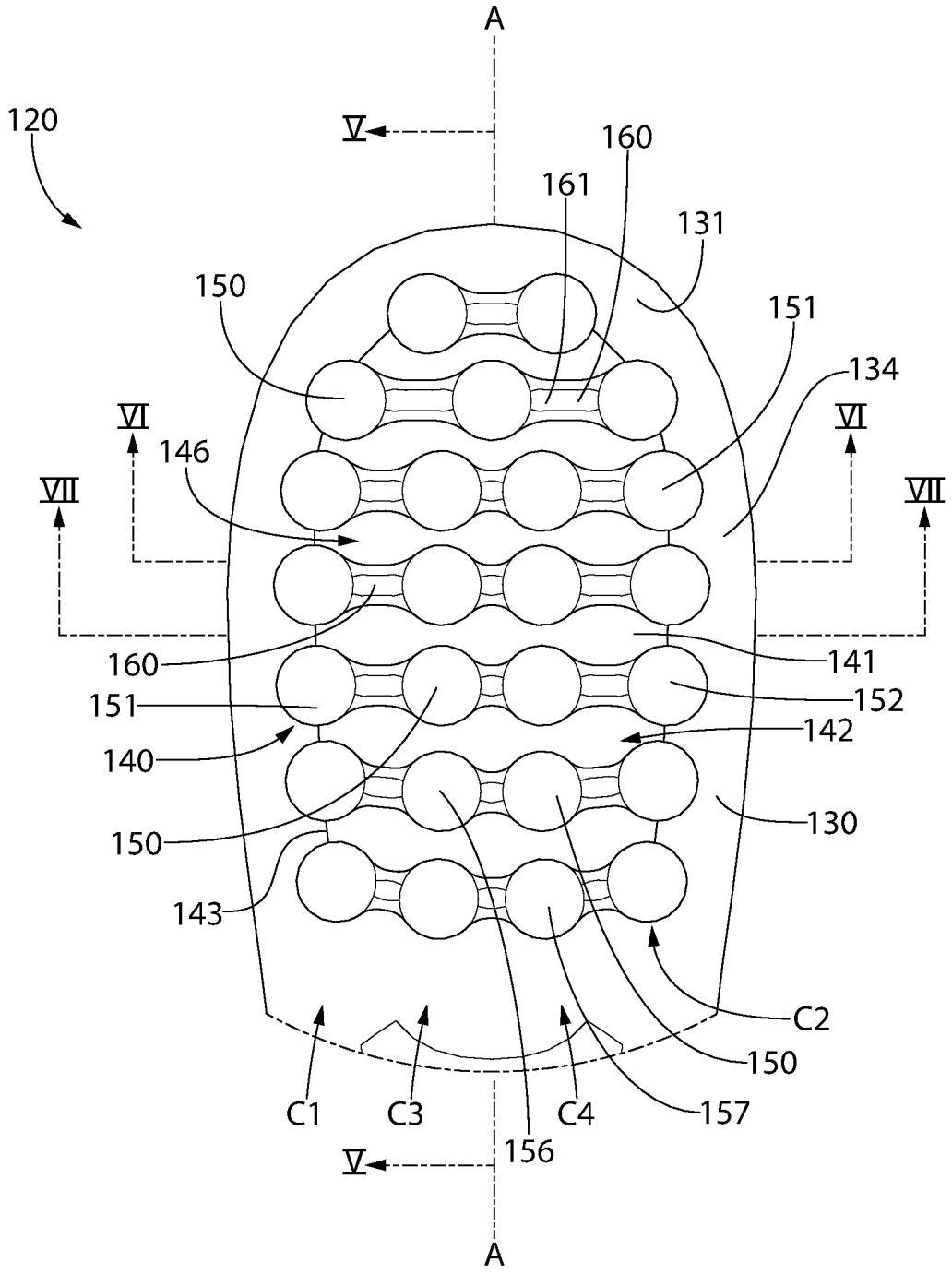
FIG. 3 is a front view of the head of the oral care implement of FIG. 1.

When viewed in a top plan view as depicted in FIG. 3, portions of the distal surface 142 of the block portion 141 are exposed between the protuberances 150 and the ribs 160. The protuberances 150 and the ribs 160 collectively form walls that extend transversely across the distal surface 142 of the block portion 141. The adjacently positioned walls are spaced apart and a channel 146 exists between the walls. The channels 146 allow for saliva and other contaminants to be easily washed off of the head 120.

Figure 4:
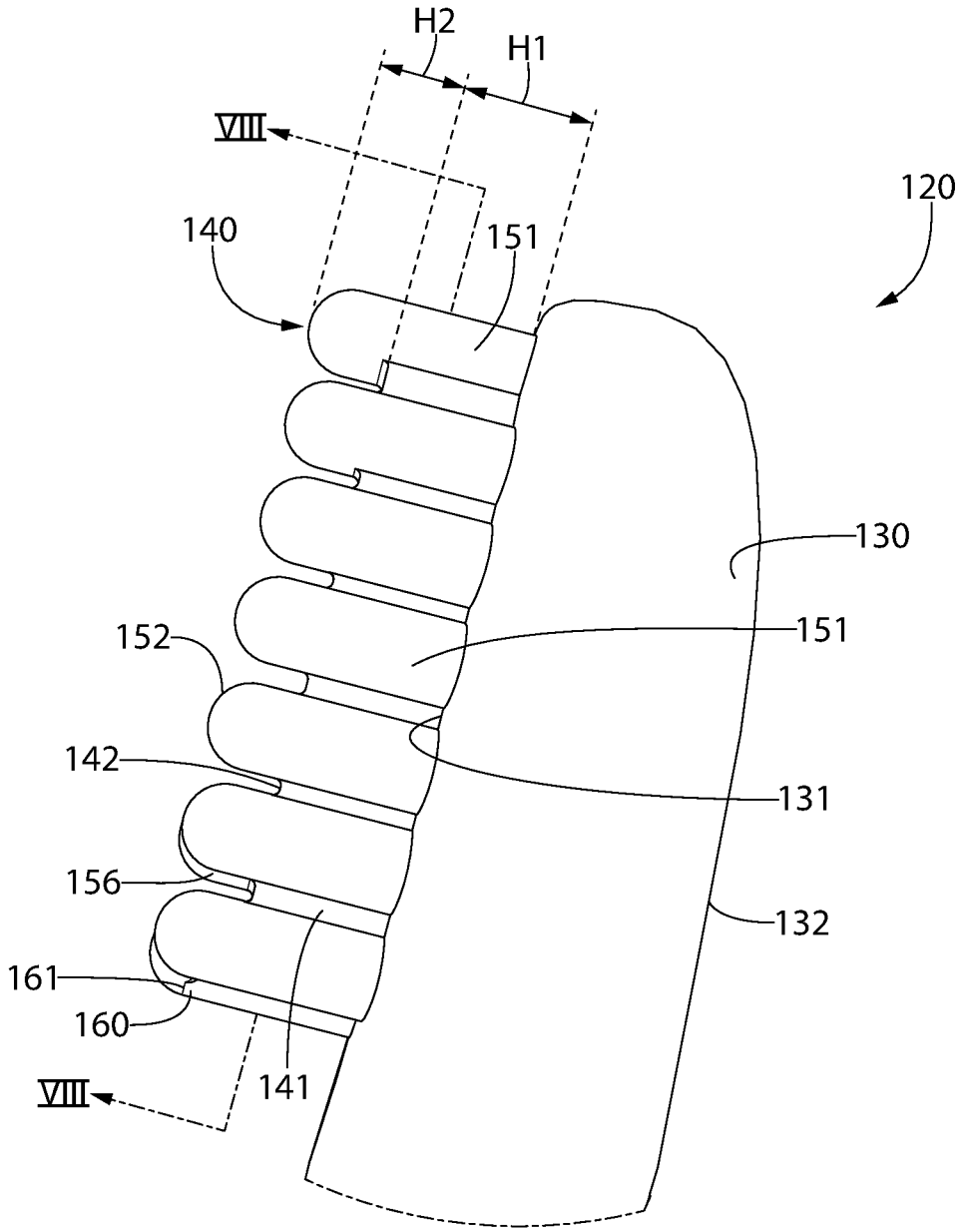
FIG. 4 is a side view of the head of the oral care implement of FIG. 1.
Figure 5:
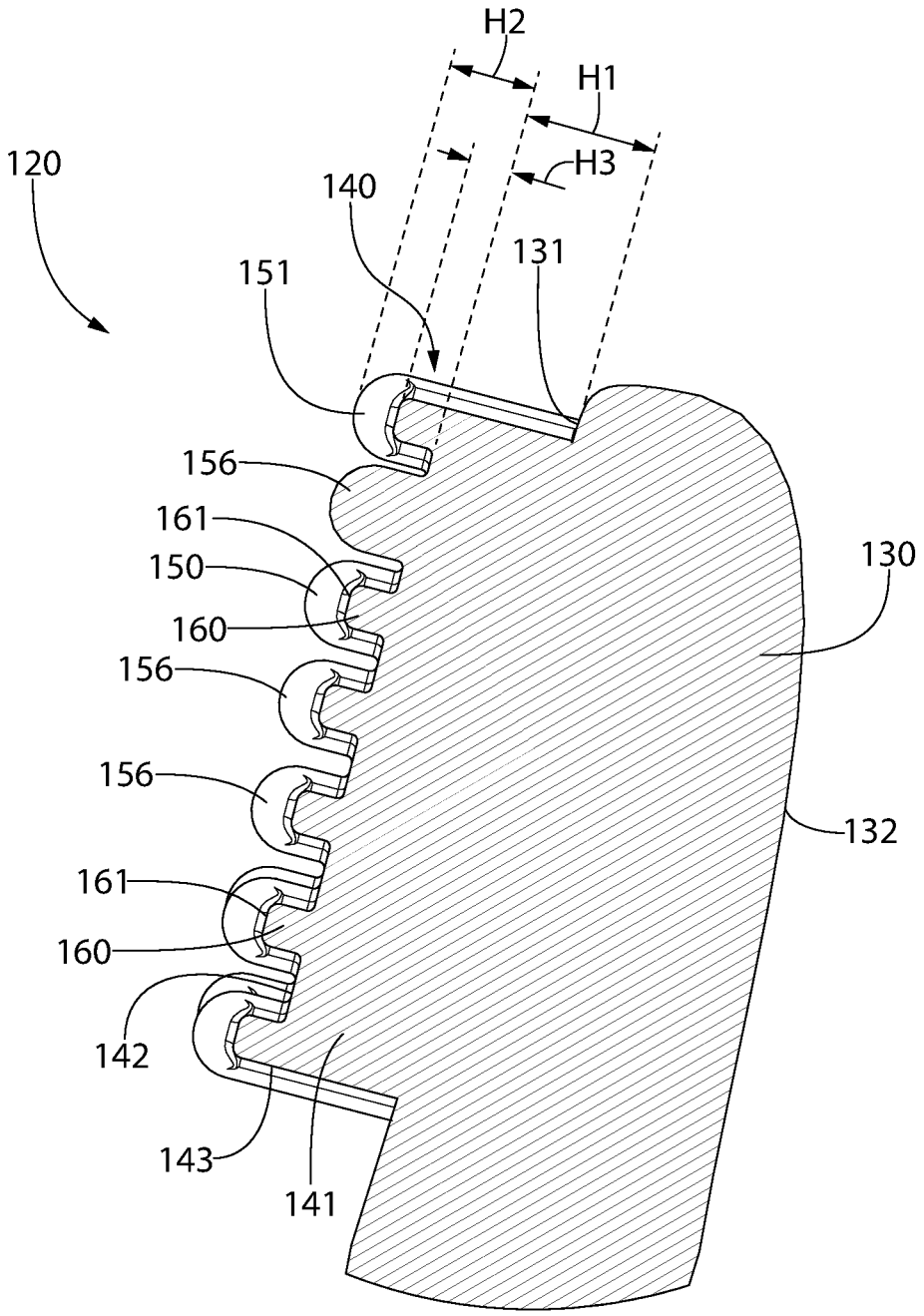
FIG. 5 is a cross-sectional view taken along line V-V of FIG. 3.
Figure 6:
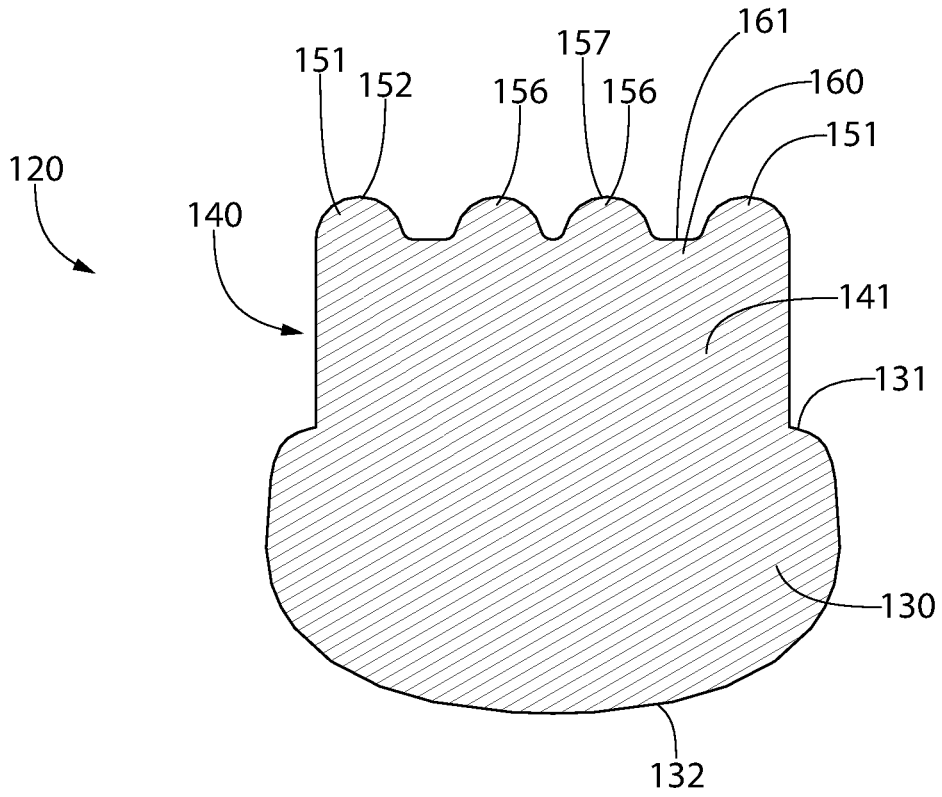
FIG. 6 is a cross-sectional view taken along line VI-VI of FIG. 3.
Figure 7:
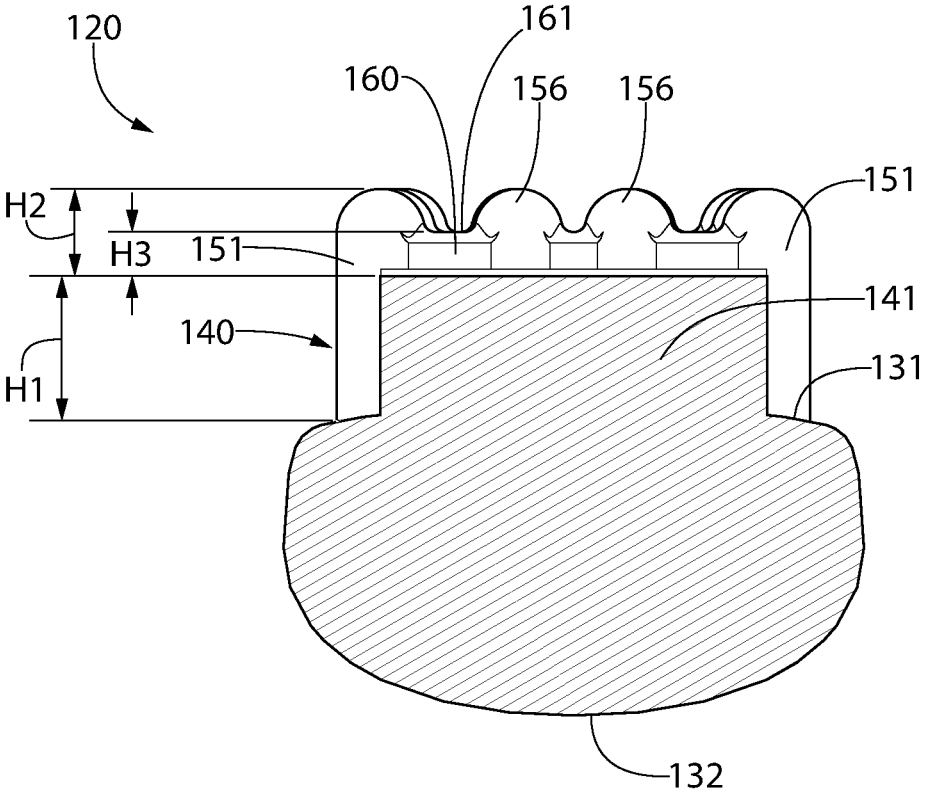
FIG. 7 is a cross-sectional view taken along line VII-VII of FIG. 3.

Referring to FIGS. 4, 5, and 7, relative heights of portions of the monolithic cleaning unit 140 will be described. The block portion 141 of the monolithic cleaning unit 140 has a first height H1 measured from the front surface 131 of the base structure 130 to the distal surface 142 of the block portion 141. In the exemplified embodiment, each of the protuberances 150 has a second height H2 measured from the distal surface 142 of the block portion 141 to the distal end of the protuberance 150. This includes the peripheral protuberances 151 and the central protuberances 156. The second height H2 is not the full height of the peripheral protuberances 151, but rather the height of the second portion 154 of the peripheral protuberances 151 that protrudes beyond the distal surface 142 of the block portion 141.

Although in the exemplified embodiment every one of the protuberances 150 has the second height H2, in other embodiments at least one of the protuberances 150 may have the second height H2, such that the protuberances 150 may have various different heights as mentioned above. This is true of both the peripheral protuberances 151 and the central protuberances 156. The ribs 160 have a third height H3 measured from the distal surface 142 of the block portion 141 to the distal end 161 of the ribs 160. In the exemplified embodiment the first height H1 is greater than the second height H2, and the second height H2 is greater than the third height H3. In some embodiments, the first height H1 may be greater than or equal to the second height H2, with the third height H3 being less than the second height H2. Thus, the protuberances 150 extend beyond the distal ends 161 of the ribs 160 such that the ribs 160 are recessed relative to the distal ends 152, 157 of the protuberances 150.

In some embodiments, the first height H1 may be between 2 mm and 3 mm, the second height H2 may be between 1 mm and 2 mm, and the third height H3 may be between 0.2 mm and 1 mm. In some embodiments, a ratio of the first height H1 to the second height H2 may be between 1.0:1 and 2.0:1, and more specifically between 1.5:1 and 2.0:1. In other embodiments a ration of the first height H1 to the second height H2 may be between 1.3:1 and 1.8:1. These relative heights allow for the monolithic cleaning unit 140 to have an appearance that closely resembles the cleaning elements of a more conventional toothbrush while ensuring that no part thereof is detached from the remainder of the oral care implement during normal use.

In some alternative embodiments, the block portion 141 of the monolithic cleaning unit 140 may be omitted such that the monolithic cleaning unit 140 may comprise only the protuberances 150 and the ribs 160. In such an embodiment, the protuberances 150 and the ribs 160 may all extend directly from the front surface 131 of the base structure 130. In this embodiment, the ribs 160 will help to ensure that the protuberances 150 are not easily detached from the base structure 130 to prevent a choking hazard.

Figure 9:
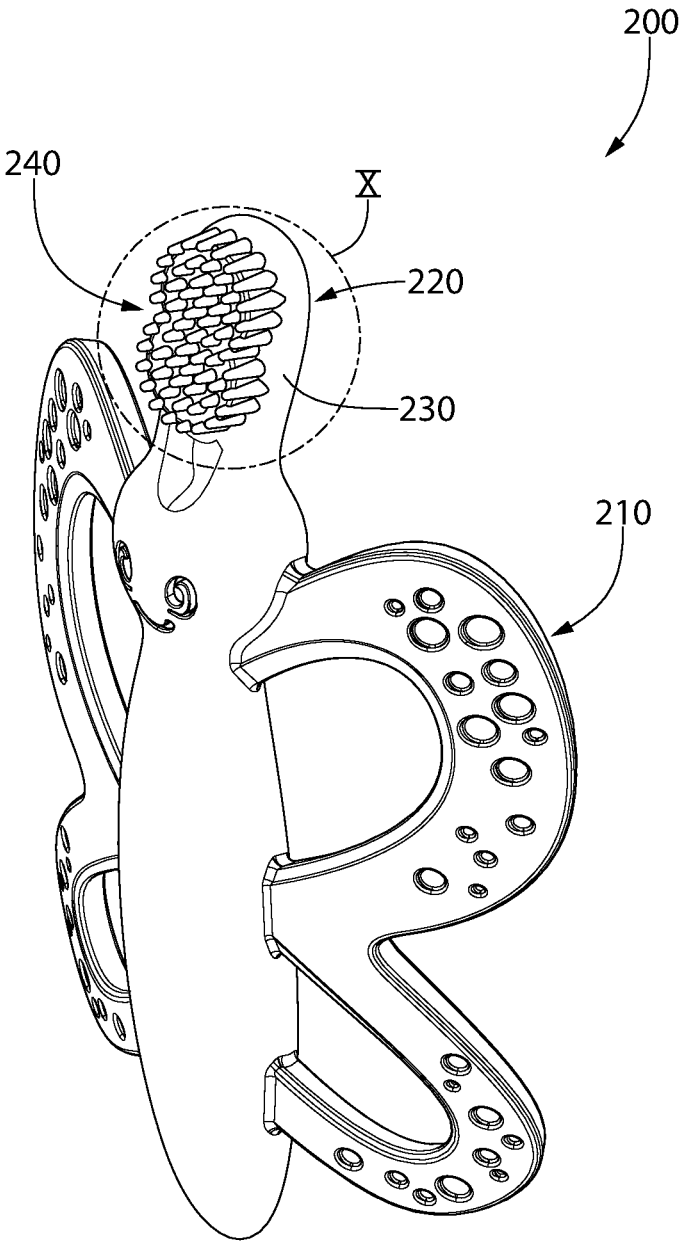
FIG. 9 is a front perspective view of an oral care implement in accordance with another embodiment of the present invention.
Figure 10:
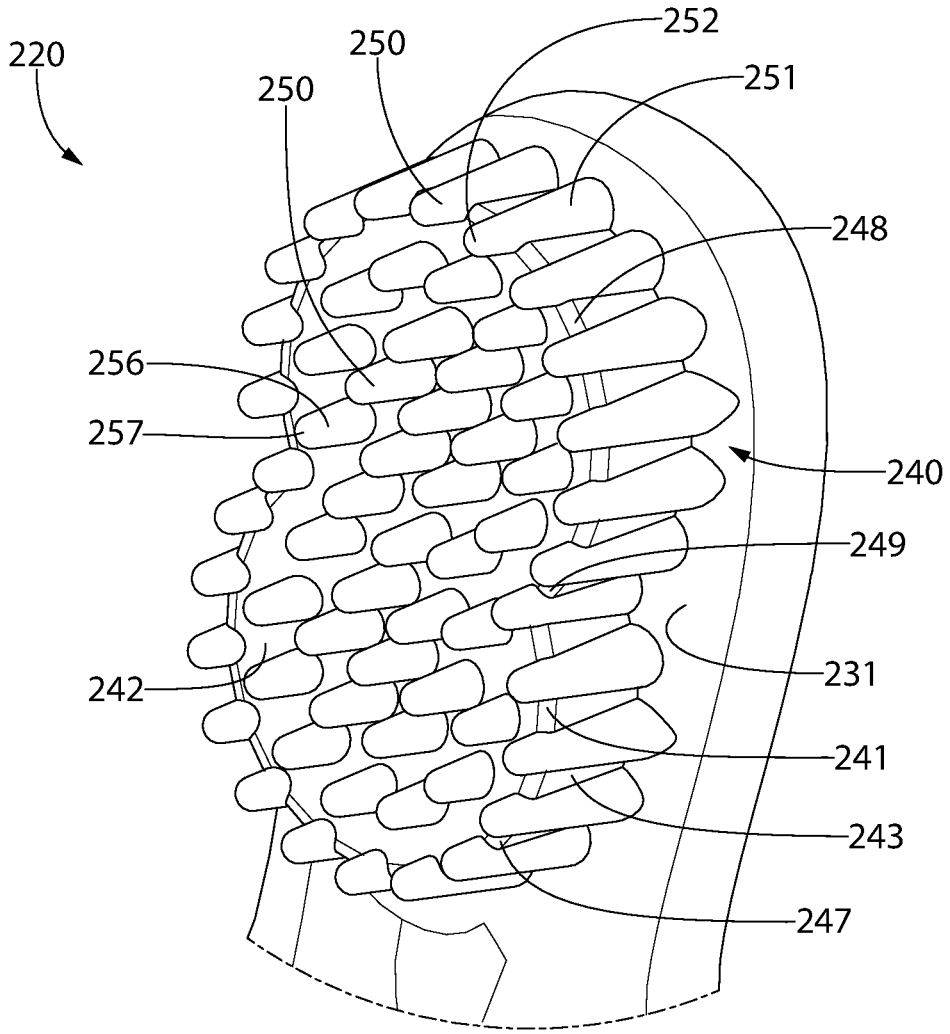
FIG. 10 is a close-up view of area X of FIG. 9 illustrating a head of the oral care implement.
Figure 11:
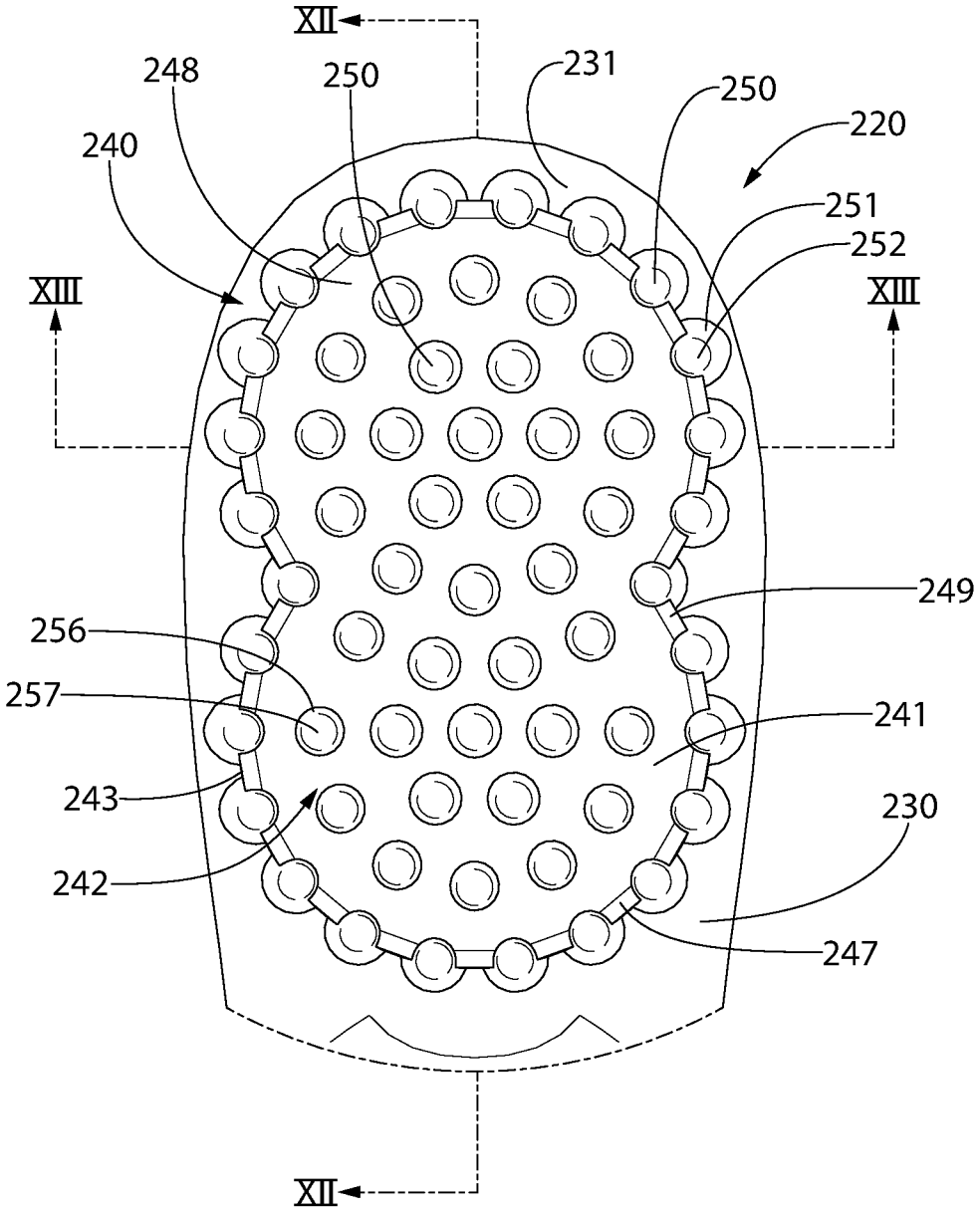
FIG. 11 is a front view of the head of the oral care implement of FIG. 9.

Referring to FIG. 9, an alternative embodiment of an oral care implement 200 is illustrated. The oral care implement 200 comprises a handle 210 and a head 220, the head 220 comprising a base structure 230 and a monolithic cleaning unit 240. The oral care implement 200 is identical to the oral care implement 100 except with regard to the structure, shape, and details of the monolithic cleaning unit 240. Thus, the description of the handle 110 and the base structure 130 of the oral care implement 100 is applicable to the handle 210 and the base structure 230 of the oral care implement 200. Those features will not be described herein in the interest of brevity.

Referring to FIGS. 10-13, the monolithic cleaning unit 240 will be further described. The monolithic cleaning unit 240 comprises a block portion 241 and a plurality of protuberances 250. The block portion 240 extends from a front surface 231 of the base structure 230 to a distal surface 242. The block portion 240 also comprise an outer surface 243. In this embodiment, the block portion 241 is in the shape of the number eight having a rounded proximal portion 247, a rounded distal portion 248, and a waist portion 249 between the proximal and distal portions.

Figure 12:
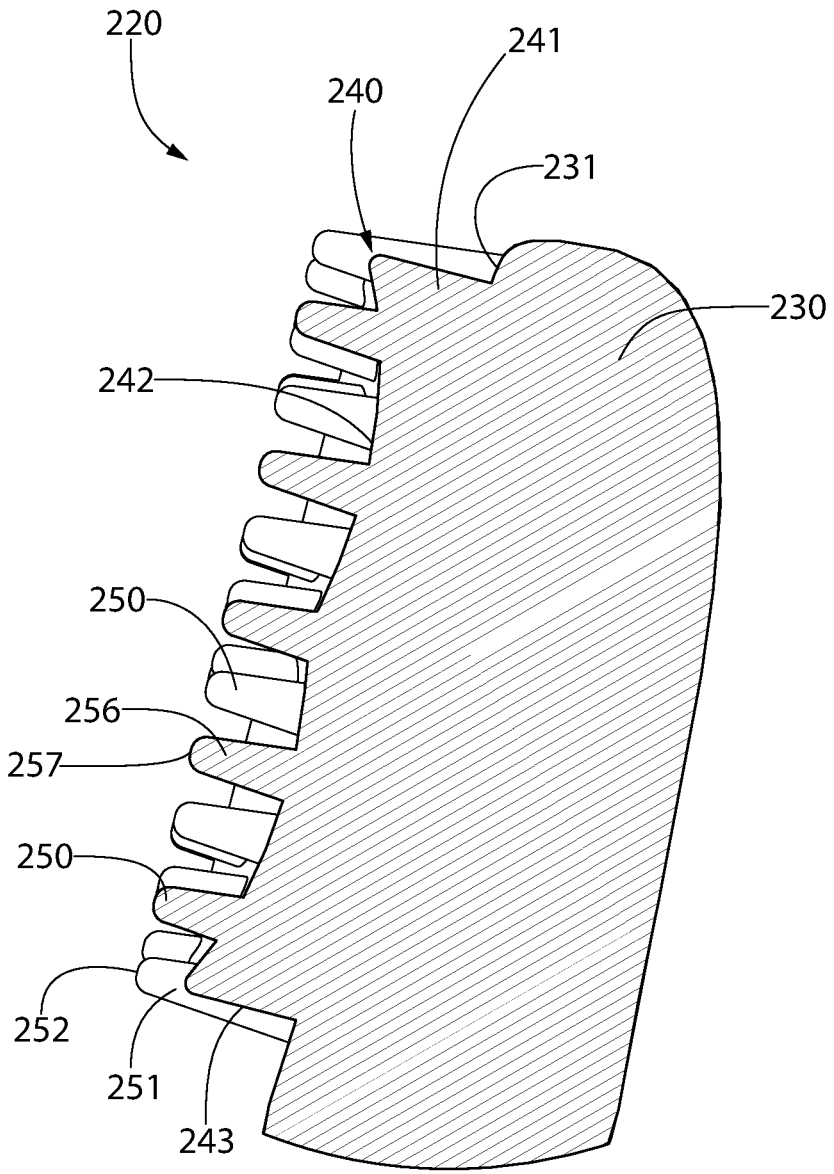
FIG. 12 is a cross-sectional view taken along line XII-XII of FIG. 11.
Figure 13:
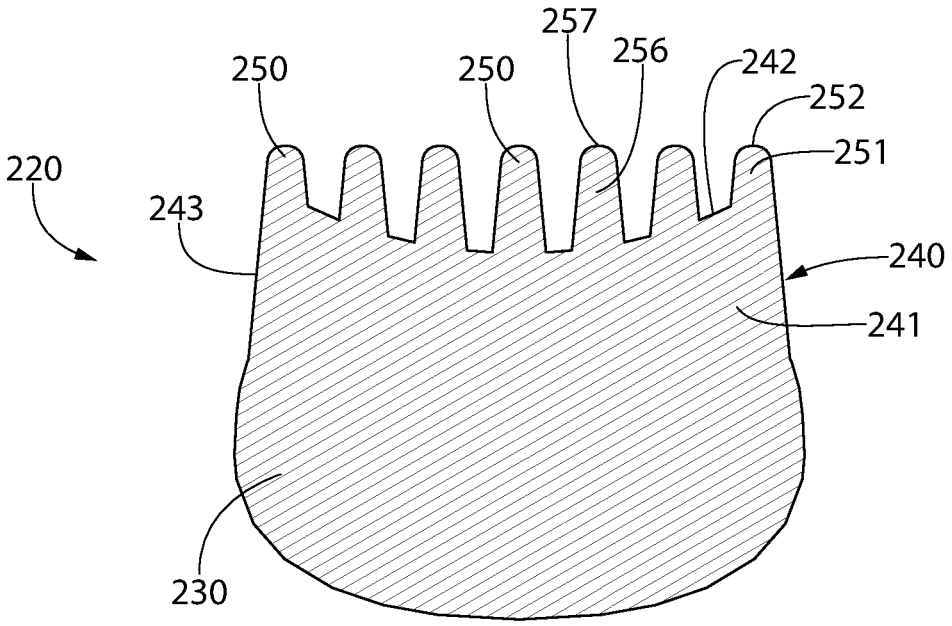
FIG. 13 is a cross-sectional view taken along line XIII-XIII of FIG. 11.

As best seen in FIGS. 12 and 13, the distal surface 242 of the block portion 240 is not flat and planar as it was with the earlier described embodiment. Rather, the distal surface 242 of the block portion 241 is curved, and more specifically concave. Moreover, in the exemplified embodiment the block portion 241 comprises two concave sections such that the proximal portion 247 has a concave distal surface 242 and the distal portion 248 has a concave distal surface 248. The two concave sections meet at the waist portion 249.

The plurality of protuberances 250 comprises a plurality of peripheral protuberances 251 that circumferentially surround the block portion 241 and a plurality of central protuberances 251. Each of the peripheral protuberances 251 extends directly from the front surface 231 of the base structure 230 to a distal end 252 whereas each of the central protuberances 256 extends directly from the distal surface 242 of the block portion 241 to a distal end 257. The peripheral protuberances 251 are coupled to the outer surface 243 of the block portion 241 and protrude from the distal surface 242 of the block portion 241.

In this embodiment, each of the protuberances 250 appears to be tapered as they extend towards their distal ends 252, 257. However, the invention is not to be so limited in all embodiments and the protuberances 250 may have a constant diameter in other embodiments. Moreover, similar to the previously described embodiment, at least one of the protuberances 250 has a height measured from the distal surface 242 of the block portion 241 to the distal end 252, 257 of the protuberance 250 that is less than the height of the block portion 241 measured from the front surface 231 of the base structure 230 to the distal surface 242 of the block portion 241. In some of the embodiments, each of the protuberances 250 has a height measured from the distal surface 242 of the block portion 241 to the distal end 252, 257 of the protuberance 250 that is less than the height of the block portion 241. As discussed previously, this helps to ensure that the protuberances 250 do not become detached from the remainder of the oral care implement 200 during normal use thereof, which could be a choking hazard because the oral care implement 200 is intended for use by babies and young children.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a base structure and a monolithic cleaning unit, the monolithic cleaning unit comprising;

a block portion extending from a front surface of the base structure to a distal surface of the block portion, the block portion having a first height measured from the front surface of the base structure to the distal surface; and a plurality of protuberances extending from the distal surface of the block portion, at least one of the plurality of protuberances having a second height measured from the distal surface of the block portion to a distal end of the at least one protuberance, the second height being equal to or less than the first height;

wherein the monolithic cleaning unit comprises a plurality of ribs extending from the distal surface of the block portion, each of the ribs of the plurality of ribs extending between two of the plurality of protuberances that are adjacent to one another.

2. The oral care implement according to claim 1 wherein each of the plurality of protuberances comprises the second height measured from the distal surface of the block portion to the distal end of the protuberance so that the distal ends of the protuberances form a flat trim profile.

3. The oral care implement according to claim 1 wherein the block portion comprises an outer surface extending from the front surface of the base structure to the distal surface of the block portion, and wherein the plurality of protuberances comprises a plurality of peripheral protuberances that surround the block portion, the plurality of peripheral protuberances comprising a first portion that protrudes radially from the outer surface of the block portion and a second portion that protrudes from the distal surface of the block portion.

4. The oral care implement according to claim 3 wherein an outer surface of the monolithic cleaning unit is formed by the outer surface of the block portion and outer surfaces of the plurality peripheral protuberances.

5. The oral care implement according to claim 1 wherein the ribs have a third height measured from the distal surface of the block portion to a distal end of the ribs, the third height being less than the second height such that the plurality of protuberances protrude beyond the distal ends of the ribs and the distal ends of the ribs are recessed relative to the distal ends of the plurality of protuberances.

6. The oral care implement according to claim 1 wherein the head comprises a longitudinal axis, and wherein each of the plurality of ribs is elongated in a direction that is generally transverse to the longitudinal axis.

7. The oral care implement according to claim 1 wherein the plurality of protuberances and the plurality of ribs collectively form walls extending from the distal surface of the block portion, and further comprising a plurality of channels located between adjacent ones of the walls.

8. The oral care implement according to claim 1 wherein the base structure and the monolithic cleaning unit are integrally formed as a single monolithic structure.

9. The oral care implement according to claim 1 wherein the plurality of protuberances comprises a plurality of peripheral protuberances that extend directly from the front surface of the base structure to distal ends of the plurality of peripheral protuberances and a plurality of central protuberances that extend directly from the distal surface of the block portion to distal ends of the plurality of central protuberances.

10. An oral care implement comprising:

a handle;

a head coupled to the handle, the head comprising a base structure and a cleaning unit, the cleaning unit comprising;

a block portion extending from a front surface of the base structure to a distal surface of the block portion; and a plurality of protuberances extending from the distal surface of the block portion;

wherein the head, including the base structure and the cleaning unit, is a monolithic structure formed from a flexible material; and wherein the plurality of protuberances comprises a plurality of central protuberances that extend directly from the distal surface of the block portion to a distal end and a plurality of peripheral protuberances that extend directly from the front surface of the base structure to a distal end, the plurality of peripheral protuberances coupled to an outer surface of the block portion and protruding beyond the distal surface of the block portion.

11. The oral care implement according to claim 10 wherein an entirety of the oral care implement including the handle and the head is a monolithic structure formed out of the flexible material.

12. The oral care implement according to claim 10 wherein the plurality of peripheral protuberances surround the block portion and the plurality of central protuberances.

13. The oral care implement according to claim 10 wherein the cleaning unit further comprises a plurality of ribs extending from the distal surface of the block portion, each of the ribs extending between two of the plurality of protuberances that are adjacent to one another, wherein the plurality of ribs are recessed relative to distal ends of the plurality of protuberances.

14. An oral care implement comprising:

a handle;

a head coupled to the handle, the head comprising a base structure and a monolithic cleaning unit, the monolithic cleaning unit comprising;

a block portion extending from a front surface of the base structure to a distal surface of the block portion;

a plurality of central protuberances extending directly from the distal surface of the block portion; and a plurality of peripheral protuberances extending from the front surface of the base structure and surrounding the block portion, the plurality of peripheral protuberances comprising a first portion that extends from an outer surface of the block portion and a second portion that protrudes beyond the distal surface of the block portion.

15. The oral care implement according to claim 14 wherein an outer surface of the monolithic cleaning unit is formed by the outer surface of the block portion and outer surfaces of the plurality of peripheral protuberances.

16. The oral care implement according to claim 14 wherein the head, including the base structure and the monolithic cleaning unit, is a monolithic structure formed from a flexible material.

17. The oral care implement according to claim 14 wherein each of the plurality of central protuberances and each of the plurality of peripheral protuberances has the same height measured from the front surface of the base structure to distal ends of the plurality of central and peripheral protuberances.

18. The oral care implement according to claim 14 wherein the monolithic cleaning unit comprises a plurality of ribs, each of the plurality of ribs extending from one of the plurality of central protuberances to one of the plurality of peripheral protuberances, wherein the plurality of ribs are recessed relative to distal ends of the pluralities of central and peripheral protuberances.

* * * * *